US005366218A

United States Patent [19]

Gong

[11] Patent Number: 5,366,218

[45] Date of Patent: Nov. 22, 1994

[54] TENNIS RACKET

[76] Inventor: Shao-Wei Gong, P.O. Box 251, Cookeville, Tenn. 38503-0251

[21] Appl. No.: 952,067

[22] Filed: Sep. 28, 1992

[51] Int. Cl.[5] ..... A63B 49/08

[52] U.S. Cl. ..... 273/73 J; 273/75

[58] Field of Search ..... 773/73 R, 73 J, 75, 773/67 R, 67 A, 67 C, 67 D, 67 DA, 81 R, 81 B, 81 D, 165; 81/489, 22, 177.1; 74/551.9; 16/110 R, DIG. 12; D8/300, 303

[56] References Cited

U.S. PATENT DOCUMENTS

| | | | |
|---|---|---|---|
| 2,091,458 | 8/1937 | Sleight | 273/75 |
| 3,036,836 | 5/1962 | Mason | 273/165 |
| 3,203,697 | 8/1965 | Berzatzy . | |
| 3,256,023 | 6/1966 | Frazelle | 273/165 |
| 3,817,521 | 6/1974 | Wright . | |
| 3,868,110 | 2/1975 | Jones . | |
| 3,905,598 | 9/1975 | Ballog . | |
| 4,006,896 | 2/1977 | Soldavini . | |
| 4,072,311 | 2/1978 | Bertucci . | |
| 4,226,418 | 10/1980 | Balfour . | |
| 4,721,305 | 1/1988 | Cudlip . | |
| 4,848,746 | 7/1989 | Klink | 273/75 X |
| 4,861,030 | 8/1989 | Burt . | |
| 4,978,123 | 12/1990 | Ashihara . | |
| 5,183,260 | 2/1993 | Kheir | 273/73 J |

FOREIGN PATENT DOCUMENTS

| | | | |
|---|---|---|---|
| 3202194 | 8/1983 | Germany | 273/73 J |

*Primary Examiner*—Vincent Millin
*Assistant Examiner*—Raleigh W. Chin

[57] ABSTRACT

A racket for the sports of tennis and the like with a special handle is presented. The handle includes a two-bar grip and two accessary shafts. The two-bar grip is formed by the extensions from the head frame of the racket which are arranged to be symmetrical and parallel, and are fixed with predetermined length and width by a opened hole clamp and a stopped hole clamp. The two accessary shafts are mounted on each of the bars of the two-bar grip with their fixing loops, and the mounting position and orientation can be adjusted.

3 Claims, 3 Drawing Sheets

TENNIS RACKET

FIELD OF THE INVENTION

This invention is related to the tennis racket and the like.

Description of the Prior Art

There are some problems with the tennis racket of prior art.

During a game, determining the position and orientation of the head face of the racket is crucial for a player. A little error of the judgement may cause him/her to lose the point. With the racket of prior art a player has to determine the position and orientation of the racket head by visual adjustment. It is rather inconvenient for a player to look at the tennis ball, the racket, the tennis court, and his opponent at the same time and return the ball properly.

The other problem of the racket of prior art is that the grip is easy to become slippery during a game. The slippery may be caused by the centrifugal force in the longitudinal direction when a player swings the racket to strike the tennis ball, or by the collision force of the ball in the cross-sectional direction when a player strikes the ball eccentrically with the head face of racket. As a result, the player must always grip the racket handle very tightly when swinging the racket and striking the ball. It leads to fatigue of the hand of the player easily, and ultimately to deterioration of the quality of the player. Also, since the player's wrist muscle is always tense during a strike it is detrimental for the player to make good use of the breakout force of the wrist.

In addition, the handle of prior art does not give a full utilization of the hand muscular power of a player. When a player uses the racket of prior art to serve, to have a forehand stroke, or to have a backhand stroke, some parts of the hand of the player do not make contributions, or are not utilized fully.

These problems have been recognized for a long time, and some modifications have been made to improve the performance of the racket. A number of inventions comprise the closer known prior art:

U.S. Pat. No. 3,203,697;
U.S. Pat. No. 3,817,521;
U.S. Pat. No. 3,868,110;
U.S. Pat. No. 3,905,598;
U.S. Pat. No. 4,006,896;
U.S. Pat. No. 4,072,311;
U.S. Pat. No. 4,226,418;
U.S. Pat. No. 4,721,305;
U.S. Pat. No. 4,861,030;
U.S. Pat. No. 4,978,123.

The innovation by Berzatzy (U.S. Pat. No. 3,203,697) provides a tennis racket handle with a cross-section of flat elliptical configuration and a L-shaped bracket. Although this innovation provides the improvement to the problems of slippery in the cross-sectional direction and flying out of hand due to centrifugal force when a player swings the racket and strikes the ball, it does not provide a structure which gives the full use of the hand power. Also, the device of the L-shaped member severely limits the wrist and hand mobility which is very important for the quality of a player in a game.

The innovation by Wright (U.S. Pat. No. 3,817,521) provides an upstanding backhand thumb stop. It intends to transmit thumb pressure force to the tennis racket held in a manner to hit a tennis ball in a backhand drive. However, it does not describe and provide a structure which emphasizes and reinforces the thumb force in forehand stroke although it provides a forehand index finger separator structure.

The innovation by Bertucci (U.S. Pat. No. 4,072,311) describes an index finger positioning device between the index finger and the middle finger when the racket is gasped by a player, which emphasizes and encourages the full use of the index finger. The device does have the index finger apply more power during a strike, but since the index finger is relatively weaker, it does not make a significant contribution to improve the conventional racket.

The innovation by Belfour (U.S. Pat. No. 4,226,418) provides a hand grip for a racket which includes four finger holes and further a plurality of finger engaging slots. Although the device does have some improvements to the problem of tactile indication of the position and orientation of the racket face and the problem of slippery it does not encourage and reinforce the full use of the hand power of a player. Also, the structure may make the player feel uncomfortable, or may hurt the player when the hole rings are inserted between the fingers in a game. It is also noticed that for the hands of different sizes, different models must be provided if the comfortableness of the user is considered.

The innovation by Burt (U.S. Pat. No. 4,861,030) uses the frame extensions from the racket head to form a handle. Two separate grips are arranged on the handle so that a player can hold the racket by both grips, and can simply let go of one grip and swing the racket with the other hand to play forehand shots. However, it is not intended for single hand user, and is not intended to reinforce the hand muscular force of the player by providing a new handle structure.

The innovation by Ashihara (U.S. Pat. No. 4,978,123) provides a racket featuring a rotary cross handle added on the shaft of a conventional racket so that a user can swing the racket while gripping the cross handle as a pivotal axis. The device allows a player to exert centrifugal force instead of muscular strength to hit a coming ball. Nevertheless, it does not provide a structure to encourage and reinforce the hand muscular power of the player.

Some other innovations (U.S. Pat. No. 3,868,110, No. 3,905,598, and No. 4,006,896) provide the modifications of the handle structure with finger grooves to place the fingers and thumb of the hand of a player. Although the finger grooves may increase the engagement with the hand of the player they do not necessarily increase the tactile perception of the angle of the face of the racket, and the hand power of the player can not be used fully with these handle structures.

All of these structures of the prior art, generally speaking, do not necessarily describe a very reasonable structure which can fully use the thumb, fingers and palm muscular force and at the same time do not limit the mobility of the hand of a player in a strike. Nor do they necessarily solve the problem of fatigue of the hand by reducing the slippery in the cross-sectional and longitudinal directions. They cannot necessarily have the player make good use of the breakout force of the wrist. Nor do they necessarily increase the tactile indication of the position and orientation of the head face of racket. Furthermore, almost all of these structures have a common disadvantage, that is, for different hands of different players, correspondence to a particular size of hand grips must be produced. Also, for right hand users and left hand users the models must be doubled. The numerous sizes and configurations of the different hands make the manufacture of these models very inconvenient, if at all possible.

SUMMARY OF THE INVENTION

In this invention, a new racket with a special handle formed by a two-bar grip and two accessary shafts is provided. The grip is formed by head frame extensions of the racket, or to be more general, by two parallel small bars or the like with proper length and width so that a player can grasp and hook the two bars as a grip with the hand. The accessary shafts are formed by the fixing screw, support shaft and fixing nut. The invention is characterized by providing some significant features of improvement to the prior art.

One of the features is to provide a new two-bar grip to reinforce the grasping force of the hand. The two-bar grip is easy for a player to generate a larger cross-sectional resisting torque than the handle of prior art, and is also easy for a player to hook the bars of the grip to have full use of the finger power.

Another feature of improvement is to provide a thumb shaft to reinforce the thumb force to generate an extra resisting force and torque in a forehand stroke.

Another feature is to provide a palm shaft to reinforce the hand palm side force to generate an extra resisting force and torque in a backhand stroke. Said palm shaft will not have the bad influence of limiting the mobility of the hand and wrist of a player when it is being used.

Also, another feature of improvement is to provide a unique combined structure of handle which can easily help a player to judge the position and orientation of the head face of racket by the tactile sensation of the hand.

Still another feature is to provide a new handle which can alleviate the fatigue of the hand of a player by mitigating the slippery in the cross-sectional and longitudinal directions, and moreover, have the player carry forward the breakout force of the wrist during a strike.

The invention with its organization, simplified force diagram analysis, manner of operation, and utilization can be best understood by making reference to the following description of the drawings and the depiction of the invention.

DESCRIPTION OF THE INVENTION

FIG. 1 is a general view of the invention for a fight hand player.

FIGS. 2, 2*a* and 2*b* show is a three direction projection view of the invention for a fight hand player.

FIG. 3 is the view of a fight hand player holding the invention in a forehand stroke.

FIGS. 4*a*, 4*b*, 4*c* and 4*d* show a is the simplified force analysis diagram with the prior art and the invention during a forehand stroke.

FIGS. 5*a*, 5*b*, 5*c*, 5*d* show a is the simplified force analysis diagram with the prior art and the invention during a backhand stroke.

FIGS. 6*a*, 6*b*, and 6*c* show a is the comparison and analysis of the handle with different cross section held by a user.

Figure 9B:
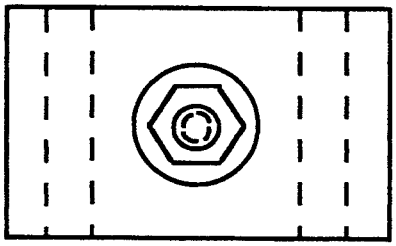
Figure 9A:
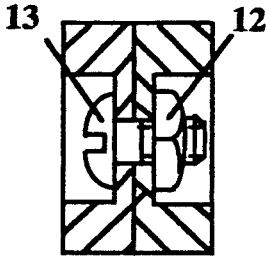
Figure 9:
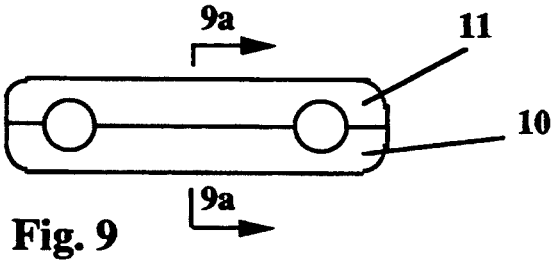

FIGS. 9, 9*a* and 9*b* show a is the front, vertical and cutaway side view of the opened hole clamp.

Figure 10B:
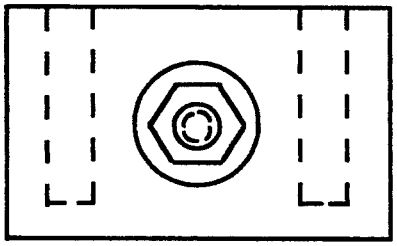
Figure 10A:
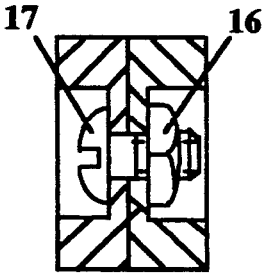
Figure 10:
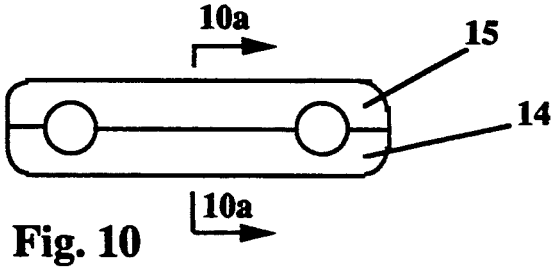

FIGS. 10, 10*a* and 10*b* show a is the front, vertical and cutaway side view of the stopped hole clamp.

Figure 1:
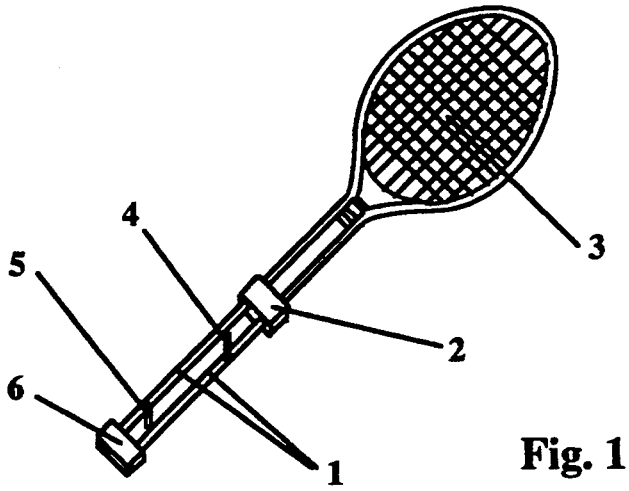

With reference to FIG. 1, it is a general view of the invention for a right hand user. Structure 3 is the head of the racket. The two bars of the head extensions 1 converge gradually and are fixed first by the opened hole clamp 2, then the two bars of extension 1 are made symmetrical and parallel and extend a certain length with a proper width, and then are fixed at the end by the stopped hole clamp 6. The two parallel bars of the extension 1 and clamp 6 may all be covered with soft material. The thumb shaft 4 and palm shaft 5 are mounted and fixed on each of the two bars of the extension 1, and the mounting position and orientation can be adjusted by the individual requirement of the player. In the case of a left hand user, the user only needs to adjust the mounting orientation of the accessary shafts to 180 degrees different from that of the right hand user.

Figure 2A:
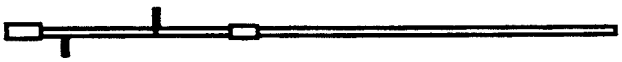
Figure 2B:
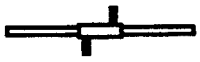
Figure 2:
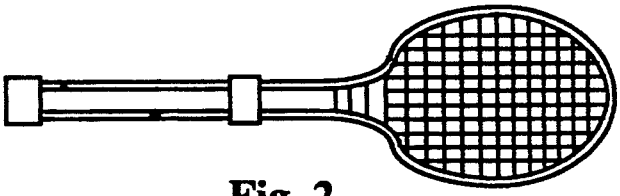
Figure 3:
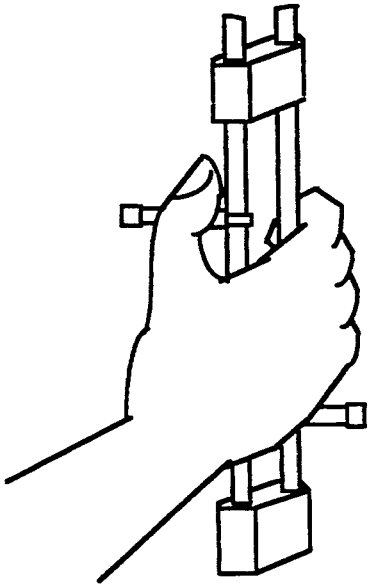
Figure 4A:
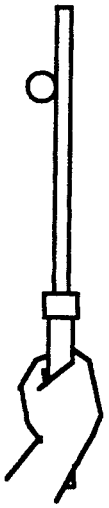
Figure 4B:
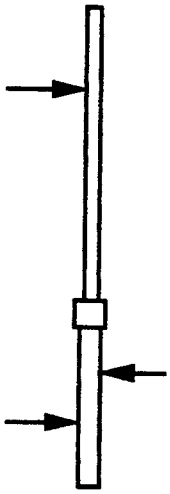
Figure 4C:
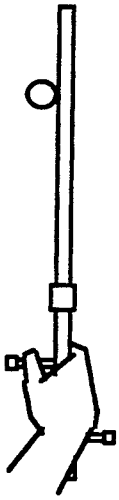
Figure 4D:
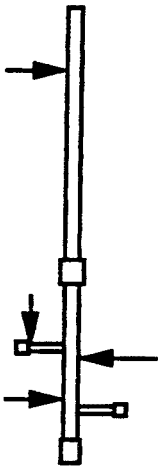
Figure 5A:
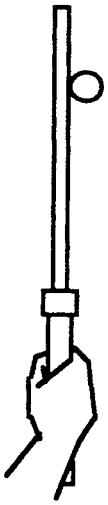
Figure 5B:
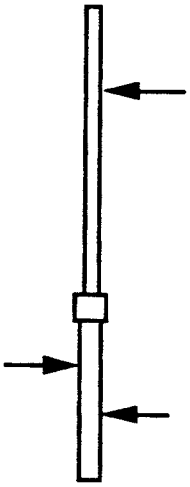
Figure 5C:
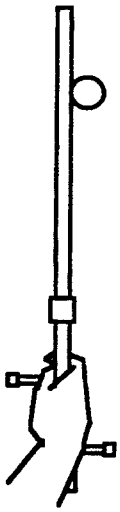
Figure 5D:
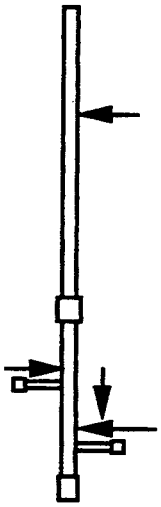

From FIG. 2 which shows the three direction projection view of the invention for a right hand player and FIG. 3 which shows the view of a right hand player holding the innovation in a forehand stroke, it is easy to understand that the invention has provided a unique structure to indicate the position and orientation of the racket head face to the player. When the player holds the racket to have a strike, the position and orientation of the racket head face can be easily judged by the tactile sensation of the hand.

FIG. 4 presents a simplified force diagram when a player uses the innovation in comparison with the prior art to have a forehand stroke. Here, the arrows are the simplified forces. When a player uses the racket to hit a coming ball there is a collision force on the racket head face which in turn causes a collision force and torque on the hand of the player. To stand the activities caused by the collision force, the player must generate necessary resisting force and torque. With the handle structure of prior art the thumb muscular force is not fully used. By comparison, with the invention the thumb force is fully used to generate an extra resisting torque to stand the collision activities through the thumb shaft 4. When the thumb force is certain, the longer the distance h, the larger the generated extra resisting torque. Also, the extra thumb force can be used to resist the centrifugal force of the racket in the longitudinal direction caused by swinging the racket during a strike. FIG. 5 indicates the simplified force analysis diagram in a backhand stroke when a player uses the prior art handle structure versus the invention. The arrows in this diagram are the simplified forces. It demonstrates that when the handle structure of the invention is utilized the large force of the low palm side of the hand is fully used to generate an extra resisting torque with the palm shaft. Also, the extra low palm side force is used to resist the centrifugal force in the longitudinal direction caused by swinging the racket.

Figure 6A:
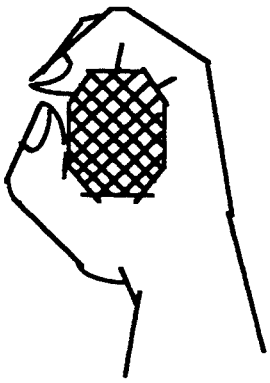
Figure 6B:
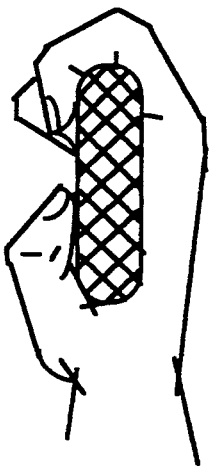
Figure 6C:
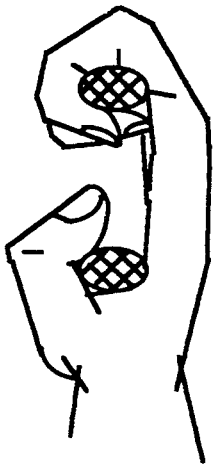

From FIG. 6, it is clear from general knowledge that when the total length of envelope lines of the cross section is the same the racket handle with the flat elliptical cross section is easy to be used by a player to generate larger cross-sectional resisting torque than the conventional handle with the cylindrical or octagonal cross section. Also, it is clear that the invention is better to be used to generate a cross-sectional resisting torque than the handle with flat elliptical cross section because the fingers of a player can hook the bars of the handle so that the finger power of the hand can be fully utilized.

The delineation of FIG. 4, FIG. 5, and FIG. 6 indicates that since the structure of the invention can easily be used by a player to generate a larger cross-sectional resisting torque than the structure of prior art, and to have an extra force to stand the centrifugal force in the longitudinal direction, the player does not always need to grasp the handle tightly, and the tension of the wrist muscles of the player can be relaxed in a strike before hitting the ball. It leads to alleviating the fatigue of the hand of a player and lets the player take advantage of the breakout force of the wrist.

Figure 7:
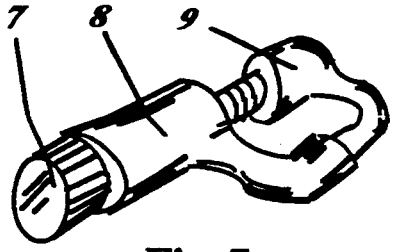
FIG. 7 is a general view of the accessary shafts.
Figure 8:
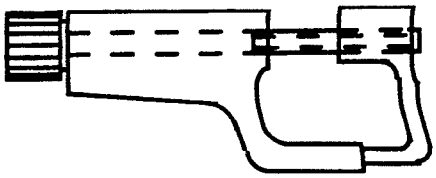
FIG. 8 is the assembly view of the accessary shafts.

As can be seen in FIG. 7, it shows the general view of the accessary shafts 4 and 5. The accessary shafts 4 and 5 may be of the same size and shape. FIG. 8 shows the assembly view of the accessary shafts. The accessary shaft is comprised by the fixing screw 7, support shaft 8 and fixing nut 9 which form a adjustable fixing loop. The thumb and palm shafts are mounted and fixed on the two bars of the extensions 1 with their loops to reinforce the thumb and low side palm power.

FIG. 9 displays the opened hole clamp 2. The front, vertical and cutaway side view are demonstrated. Parts 10 and 11 are of the same size and shape. They are fastened by the bolt 13 and nut 12 to fix the bars of the extension 1 with the open holes. FIG. 10 is the stopped hole clamp 6. Here, the front, vertical and cutaway side view are also shown. Parts 14 and 15 are of the same size and shape. They are fastened by the bolt 17 and nut 16 to fix the end of the two bars of the extension 1 with the half stopped holes. The opened hole and stopped hole clamps are used to fix the two-bar grip and increase the rigidity and strength of the handle structure.

Having presented my invention, I claim:

1. A racket having a head connected to a single handle, said handle comprising a two-bar grip;

said grip comprising two extension bars extending from the racket head and being parallel to the longitudinal axis of the racket;

a thumb shaft mounted on one of said extension bars on one side of a plane defined by said racket head at an angle to engage the thumb of a player;

a palm shaft mounted on the other of said extension bars on the other side of said plane at an angle to engage the palm side of a player.

2. The racket according to claim 1 wherein said thumb shaft and said palm shaft are individually adjustable whereby a player orients the shafts along longitudinal and transverse directions at certain angles to a desired position.

3. The racket according to claim 1 further including a stopped-hole clamp positioned at the end of said extension bars to form a solid connecting block;

An opened-hole clamp positioned along said extension bars between said stopped-hole clamp and said racket head to form an unmovable connecting block;

whereby said clamps strengthen and fix said extension bars.

* * * * *